United States Patent [19]

Bonnet

[11] Patent Number: 4,506,992

[45] Date of Patent: Mar. 26, 1985

[54] WATCH CASE PROVIDED WITH INTEGRAL BRACELET

[75] Inventor: Eric Bonnet, La Chaux de Fonds, Switzerland

[73] Assignee: Jean Lassale S.A., Geneva, Switzerland

[21] Appl. No.: 510,978

[22] Filed: Jul. 5, 1983

[51] Int. Cl.[3] ..... G04B 37/00

[52] U.S. Cl. ..... 368/282

[58] Field of Search ..... 368/287, 282; 224/164, 224/169, 170, 171

[56] References Cited

U.S. PATENT DOCUMENTS

| | | | |
|---|---|---|---|
| 3,469,391 | 9/1969 | Thevenaz | 368/282 |
| 3,675,414 | 7/1972 | Cachelin | 368/282 |
| 4,034,552 | 7/1977 | Davidson | 368/282 |

FOREIGN PATENT DOCUMENTS

| | | | |
|---|---|---|---|
| 1598983 | 8/1970 | France . | |
| 320664 | 5/1957 | Switzerland | 368/282 |
| 343947 | 2/1960 | Switzerland | 368/282 |
| 351224 | 2/1961 | Switzerland | 368/282 |
| 481416 | 7/1969 | Switzerland | 368/282 |
| 536083 | 6/1973 | Switzerland . | |

*Primary Examiner*—Vit W. Miska

*Attorney, Agent, or Firm*—Robert E. Burns; Emmanuel J. Lobato; Bruce L. Adams

[57] ABSTRACT

The two parts of a leather watch strap are adhesively secured to flexible metal tongues integral with a metallic body mounted in an annular groove in a watch case body, for example between a crystal and back. The flexible metal tongues are, for example, of beryllium bronze inserted and soldered in slits of the annular attaching body and the leather watch strap portions are each adhesively secured to these tongues. A metal bracelet can be soldered directly to the annular attaching body.

8 Claims, 5 Drawing Figures

WATCH CASE PROVIDED WITH INTEGRAL BRACELET

FIELD OF THE INVENTION

The present invention relates to a wrist watch case provided with a bracelet, notably a two-piece leather watch strap integral with the case.

BACKGROUND OF THE INVENTION

Heretofore, leather watch straps have always been attached to the watch case by means of small bars or pins, in particular spring pins, mounted between two lugs provided on the case. To integrate the watch strap with the case, the lugs have been replaced by grooved borders provided on the case which receive and hide the small bars. However, this is not a true integration of the watch strap and the case and such a solution is practically impossible with a very thin watch case of the order of 2 mm to 3 mm, such as those known today.

Another solution for dispensing with the lugs has been proposed in utility model No. JP 1268962. In this construction, the watch strap is provided with small bars which are retained in grooves provided in two quasi-symmetrical parts of the case which are applied one on the other. Such solution is limited to a special type of case. Moreover, application of the watch strap is delicate and the strap becomes detached and falls off whenever the case is opened.

SUMMARY OF THE INVENTION

It is an object of the invention to provide integral fixation of a leather or metal bracelet to a watch case without small bars or pins, utilizable with round cases or very thin cases, which can be easily put in place and does not automatically become detached when the case is opened.

For that purpose the watch-bracelet case according to the invention is characterized by the fact that the bracelet is fixed to a metallic body mounted in an annular recess of the case in which it is retained by a part of the case. If the bracelet is leather, it is preferably fixed on flexible metal tongues by adhesive and/or mechanical means such as rivets, these tongues being embedded and soldered in the metallic body.

If the annular recess is constituted by a groove in the watch case body, such groove is closed by the back of the case so that the metallic body is completely hidden in the case and the leather watch band or braclet seems to have been made a part of the case.

BRIEF DESCRIPTION OF DRAWINGS

The nature objects and advantages of the invention will be more fully understood from the following description of a preferred embodiment shown by way of example in the drawings in which.

DESCRIPTION OF PREFERRED EMBODIMENT

Figure 1:
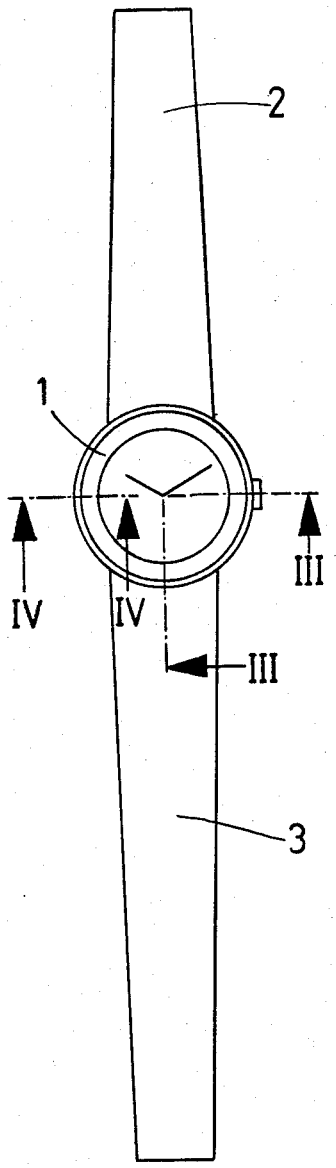
FIG. 1 is a schematic plan view of the complete watch including a leather watch strap.
Figure 2:
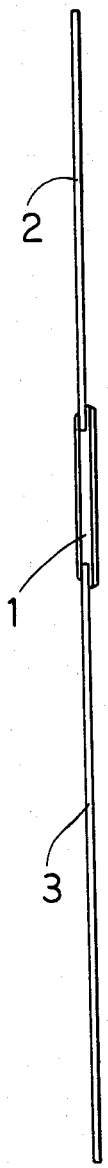
FIG. 2 is a side view.

The watch-bracelet shown by way of example in FIGS. 1 and 2 comprises a watch case 1 to which are fixed in an integral manner two parts 2 and 3 of a leather bracelet of which the clasp or buckle has not been shown.

The watch case 1 is shown as comprising an annular case body 4 to which is pressure fitted a case back 5 to which is soldered a ring 6 designed to support a movement 7 surmounted by a dial 8. The ring 6 is provided externally at at least two opposite points with a notch 9 engaging with a projection 10 of the case body 4 to secure the case body and back together. The case body 4 has a part 4*a* forming the border for the dial and a bezel portion 4*b* designed to receive the plane crystal 11.

Figure 3:
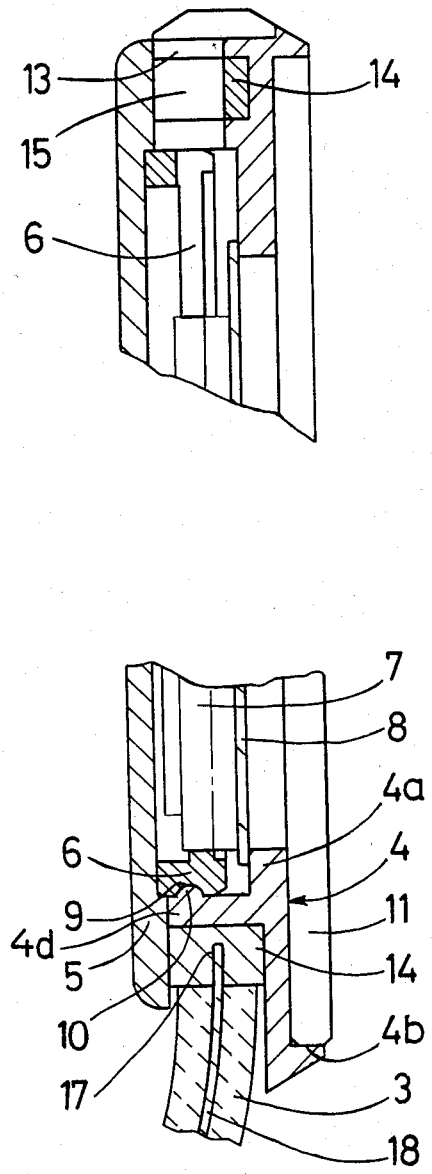
FIG. 3 is a partial section taken along the line III—III in FIG. 1.
Figure 4:
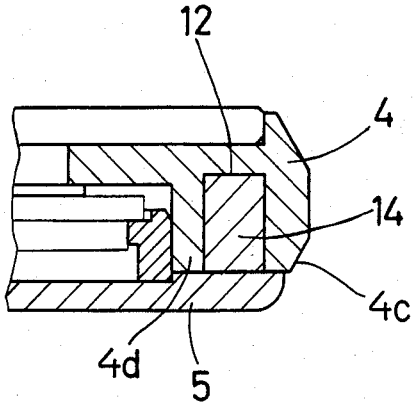
FIG. 4 is a partial section taken along the line IV—IV in FIG. 1.
Figure 5:
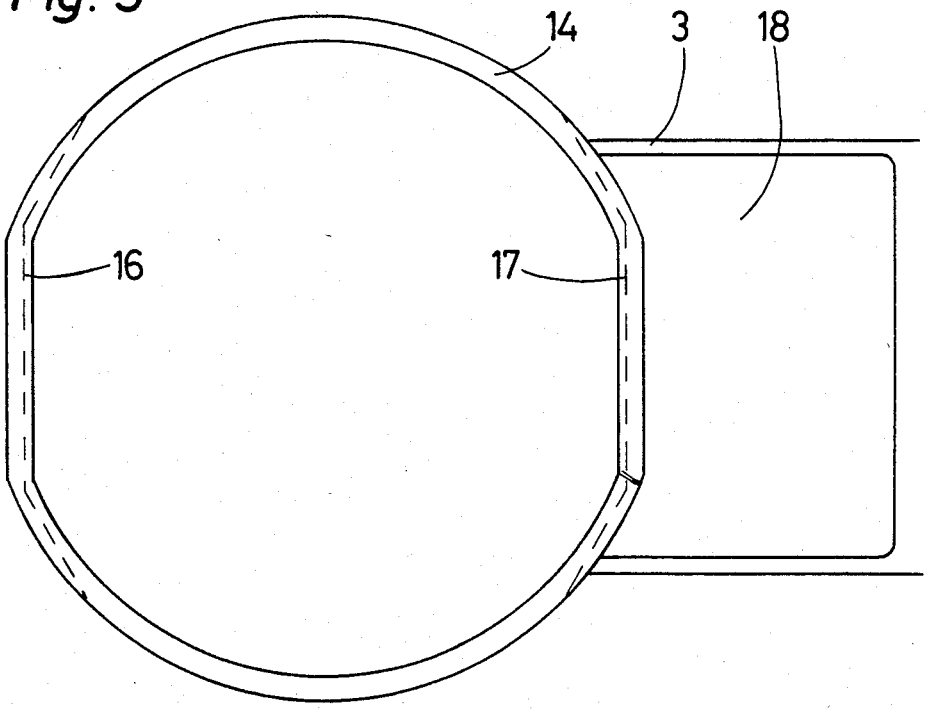
FIG. 5 is a plan view of the anchoring body of the watch strap.

As seen particularly from FIG. 4, the case body 4 has an annular groove 12 of rectangular cross section extending all around its circumference and opening to the back of the case body. The annular groove 12 is defined by an outer peripheral wall 4*c* and an inner wall 4*d*. The outer wall 4*c* of the groove 12 has two interruptions corresponding to the width of the watch strap as is seen in the right hand part of FIG. 3. Moreover, the outer wall has a round opening 13 (FIG. 3) for passage of the stem of the crown shown schematically in FIG. 1. In the groove 12 there is lodged a metallic anchor ring 14, for example of brass, which is shown alone in FIG. 5. The groove 12 being completely closed by the back 5, the ring 14 is retained and hidden in the interior of the case body 4. At the three-hour position, body 4 has a U-shaped notch 15 coinciding with the round opening 13 in the peripheral wall of the case body for the passage of the stem of the crown. At opposite sides the ring 14 is flattened as seen in FIG. 5 and is provided with two narrow horizontal slots 16 and 17 in which are inserted two flexible tongues 18 of beryllium bronze, one of the tongues being shown in FIGS. 3 and 5. These tongues are moreover, soldered in the slots in the ring 14. The end of the leather strap portion 3 is split so as to receive and completely enclose one of the flexible tongues 18 and is adhesively secured to the tongue. The strap part 2 is secured in like manner on or around the other tongue (not shown). Alternatively, or additionally, the strap portions are secured to the tongues mechanically, for example by rivets. The total thickness of the strap portions at the point of encasement of the tongues is equal to two thicknesses of the leather and the thickness of the tongue which is only about 0.1 mm. The total thickness of the watch strap adjacent the watch case which determines the height of the ring 14 is relatively small. It is for example of the order of 1.40 mm and has practically no influence on the total height of the watch case.

The anchor ring 14 permits making the watch strap in one piece with the means for attaching it to the watch case. By simply placing the ring 14 in the annular groove provided in the watch case body, the two parts of the watch strap are fixed simultaneously and correctly to the watch case.

The invention is in no way limited to the embodiment described above. As a variant, a watch case attaching body of this kind can equally be used with a watch case composed of three parts, that is to say a case body sandwiched between the watch bezel and the case back attached together by a screws. If the bracelet is metallic instead of leather, it can be soldered directly to the metallic ring 14 for example by its first link.

What I claim is:

1. A wrist watch case and integral bracelet comprising:

an annular case body having an annular groove formed in said case body and opening toward the back of said watch case, said case body having an outer peripheral wall outside said groove, a case body removably affixed to said case body and closing said groove and the back of the watch case, an anchor ring received in said annular groove and retained in said groove by said case back, and a flexible, non-metallic watch strap having opposite strap parts attached to said ring at opposite sides of said watch case, said outer peripheral wall of said case body having openings at opposite sides of said watch case of a size for passage of said watch strap parts, said anchor ring being enclosed in said groove by said outer peripheral wall of said case body and said case back.

2. A wrist watch case and integral bracelet according to claim 1, in which said strap parts are of leather and have split end portions, and in which said strap parts are affixed to said ring by flexible metal tongues secured in split end portion of said strap parts and secured in slits in said ring.

3. A wrist watch case and integral bracelet according to claim 2, in which said anchor ring is a continuous metallic ring having slits in opposite side thereof and in which said metallic tongues are secured in said slits by soldering.

4. A wrist watch case and integral bracelet according to claim 3, in which said tongues have a thickness of the order of 0.1 mm and the total thickness of the watch strap adjacent the watch case is of the order of 1.4 mm.

5. A wrist watch case and integral bracelet according to claim 1, in which said annular groove is defined between said outer peripheral wall of said case body and an annular inner wall having a projection on the inner face thereof and in which said case back has a ring portion fitting inside said inner wall of said case body with a recess receiving said projection on said inner wall of said case body to retain said case back on said case body.

6. A wrist watch case and integral bracelet according to claim 3, in which said metallic ring has a U-shaped notch positioned to receive a watch stem.

7. A wrist watch case and integral bracelet comprising:

a case body having an annular groove formed between an outer peripheral wall and an inner wall, said groove opening toward the back of said watch case, a case back removably affixed to said case body to close the back of the watch case and to close said annular groove, an anchor ring received in said annular groove and enclosed in said groove by said case back, a leather strap comprising two strap parts having split end portions, and means securing said strap parts to said anchor ring, said means comprising thin flexible metal tongues secured respectively in said split end portion of said strap parts, passing through openings in said outer peripheral wall of said case body and secured to said anchor ring.

8. A wrist watch case and integral bracelet according to claim 7, in which said anchor ring is metallic and in which said flexible metal tongues are secured to said anchor ring by being received in slits in said ring and being soldered therein.

* * * * *

UNITED STATES PATENT AND TRADEMARK OFFICE

CERTIFICATE OF CORRECTION

PATENT NO. : 4,506,992

DATED : Mar. 26, 1985

INVENTOR(S) : Eric Bonnet

It is certified that error appears in the above-identified patent and that said Letters Patent is hereby corrected as shown below:

On the title page;

"[22] Filed Jul. 5, 1983"

Insert:

--Foreign Application Priority Data--

--Jul. 2, 1982 SW Switzerland 4048/82-1--

In column 3, line 10

Delete "body" (first occurrence) and insert --back--.

Signed and Sealed this

*Twentieth* Day of *August 1985*

[SEAL]

*Attest:*

DONALD J. QUIGG

*Attesting Officer*

*Acting Commissioner of Patents and Trademarks*